US011964743B2

(12) United States Patent
Collins, Jr.

(10) Patent No.: US 11,964,743 B2
(45) Date of Patent: Apr. 23, 2024

(54) FLOATATION APPAREL SYSTEM

(71) Applicant: Roger Collins, Jr., Murrieta, CA (US)

(72) Inventor: Roger Collins, Jr., Murrieta, CA (US)

( * ) Notice: Subject to any disclaimer, the term of this patent is extended or adjusted under 35 U.S.C. 154(b) by 0 days.

(21) Appl. No.: 17/901,992

(22) Filed: Sep. 2, 2022

(65) Prior Publication Data

US 2024/0076019 A1 Mar. 7, 2024

(51) Int. Cl.
*B63C 9/105* (2006.01)

(52) U.S. Cl.
CPC ..... *B63C 9/1055* (2013.01)

(58) Field of Classification Search
CPC ..... B63C 9/093; B63C 9/105; B63C 9/1055; B63C 9/115; B63C 9/125; B63C 9/1255; B63C 2011/043; B63C 2011/046; A41D 7/001; A41D 7/003
See application file for complete search history.

(56) References Cited

U.S. PATENT DOCUMENTS 1,596,573 A * 8/1926 Beaulieu ..... A41D 7/003 441/102
1,842,653 A 1/1932 Black
2,443,474 A 6/1948 Morgan
3,023,433 A 3/1962 Davyso
3,134,993 A * 6/1964 McCoy ..... A41D 7/003 441/102
4,291,427 A 9/1981 Rhea
5,022,878 A 6/1991 Casad
5,502,842 A * 4/1996 Wagner ..... A41D 7/003 441/120
5,778,451 A 7/1998 Rhea
D439,028 S * 3/2001 Shaffer ..... D2/731
6,260,199 B1 * 7/2001 Grunstein ..... A41D 7/001 441/115
8,104,096 B1 * 1/2012 Jenney ..... A41D 7/003 2/DIG. 3
D763,548 S 8/2016 Harmande
2016/0332711 A1 * 11/2016 Harrington ..... A41D 13/005
2018/0021631 A1 * 1/2018 Hsu ..... B63C 9/155 441/107

FOREIGN PATENT DOCUMENTS

FR 2738995 A1 * 3/1997 ..... A41D 7/001
GB 2259237 8/1991

* cited by examiner

*Primary Examiner* — Andrew Polay

(57) ABSTRACT

A floatation apparel system for discreetly providing buoyancy includes a garment being worn by a user while engaged in aquatic activities. The garment includes a plurality of body apertures having a portion of a person's body extending through. Each body aperture has a perimeter edge, and at least one tubular ring is attached to the garment and is co-extensive with one of the body apertures. Furthermore, at least one tubular ring is buoyant in water.

10 Claims, 11 Drawing Sheets

FLOATATION APPAREL SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to swimwear device and more particularly pertains to a new swimwear device for discreetly providing buoyancy.

(2) Description of Related Art Including Information Disclosed Under 37 CFR 1.97 and 1.98

The prior art relates to swimwear devices. The prior art includes a variety of swimwear devices configured for providing buoyancy within a body of water. Known prior art lacks a swimwear device configured for discreetly providing buoyancy to the swimwear.

BRIEF SUMMARY OF THE INVENTION

An embodiment of the disclosure meets the needs presented above by generally comprising a garment configured for being worn by a user while engaged in aquatic activities. The garment includes a plurality of body apertures configured to have a portion of a person's body extending therethrough. Each body aperture has a perimeter edge, and at least one tubular ring is attached to the garment and is co-extensive with one of the body apertures. Furthermore, at least one tubular ring is buoyant in water.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
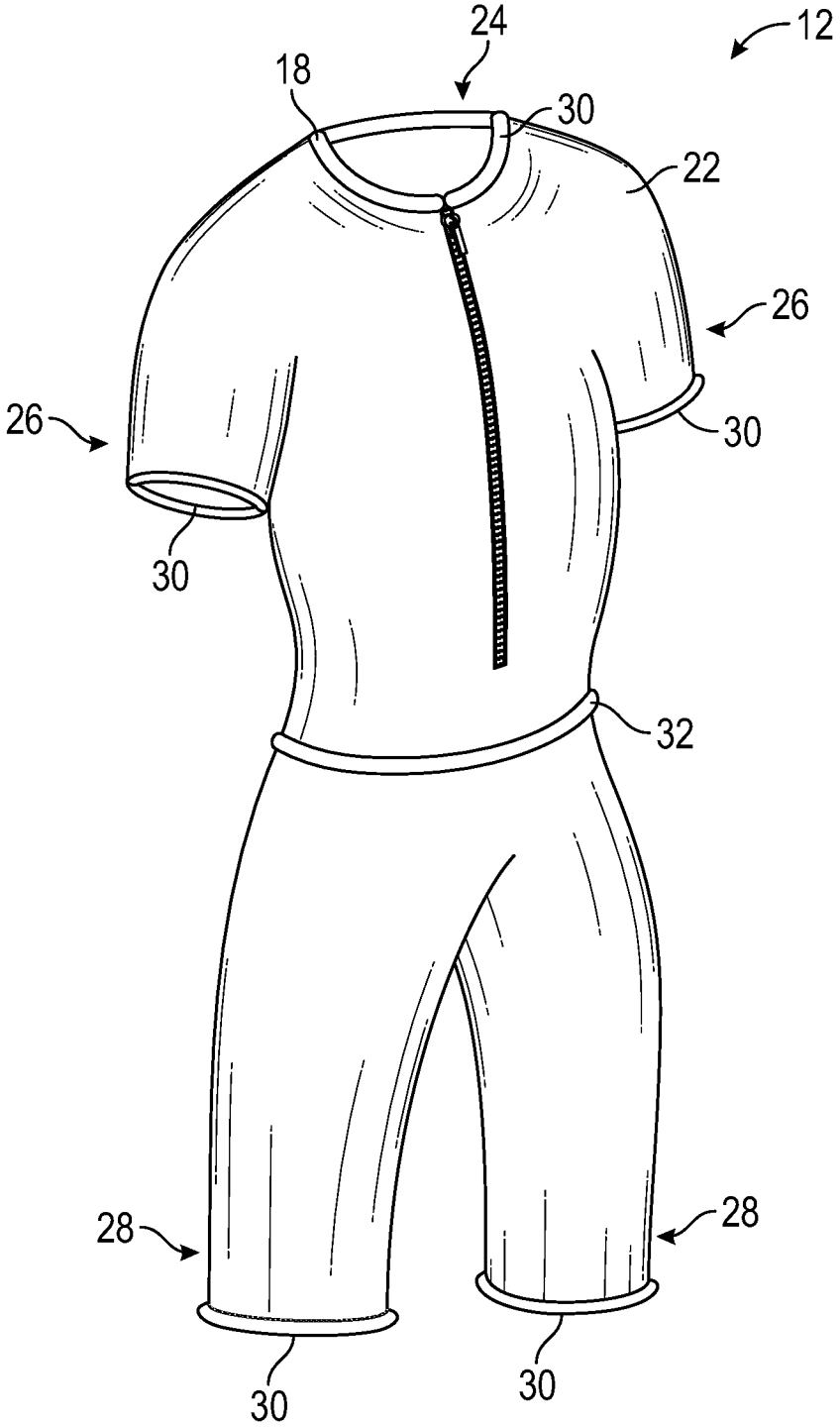
FIG. 1 is a front isometric view of a floatation apparel system according to an embodiment of the disclosure.
Figure 2:
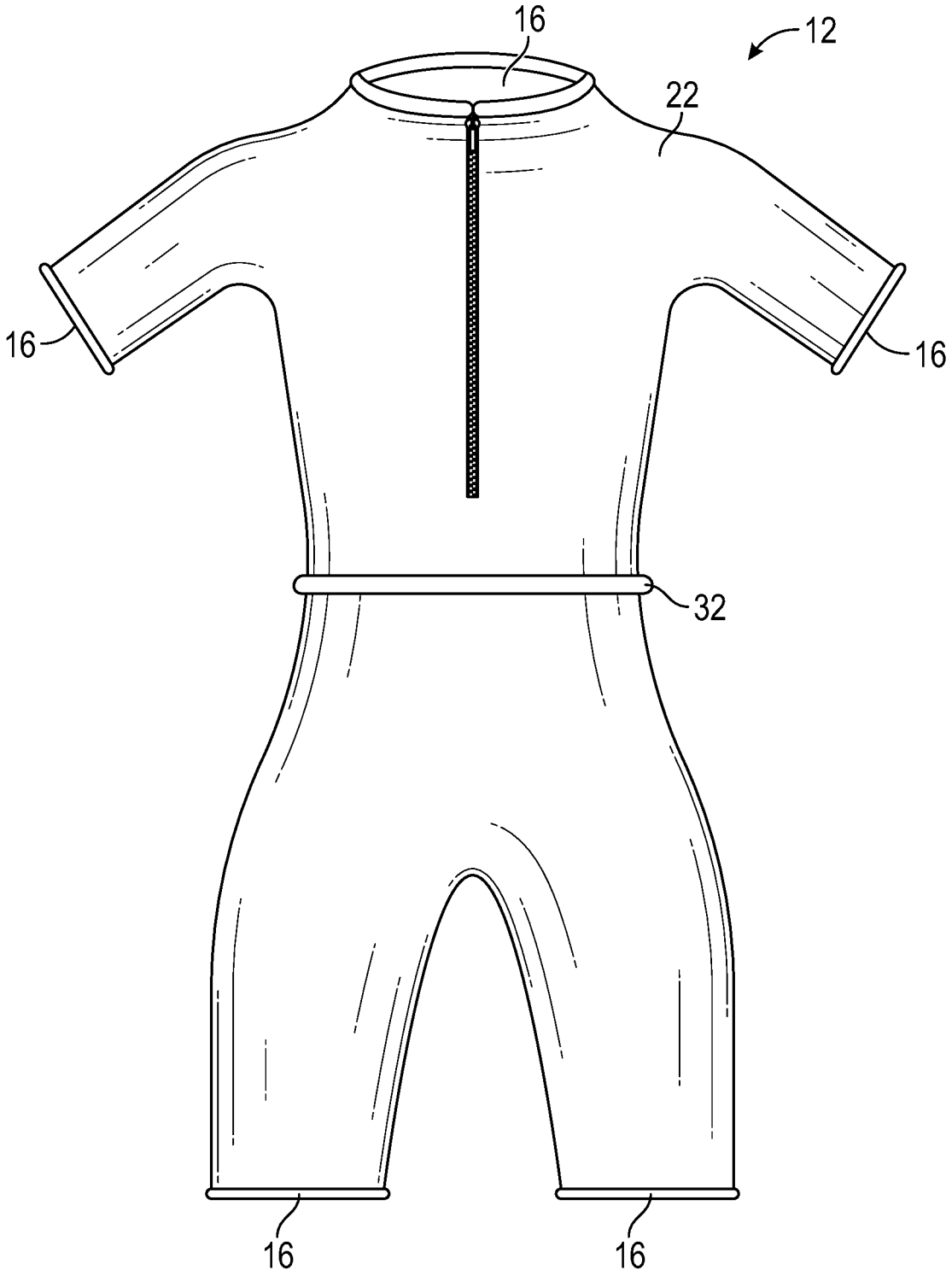
FIG. 2 is a front view of an embodiment of the disclosure.
Figure 3:
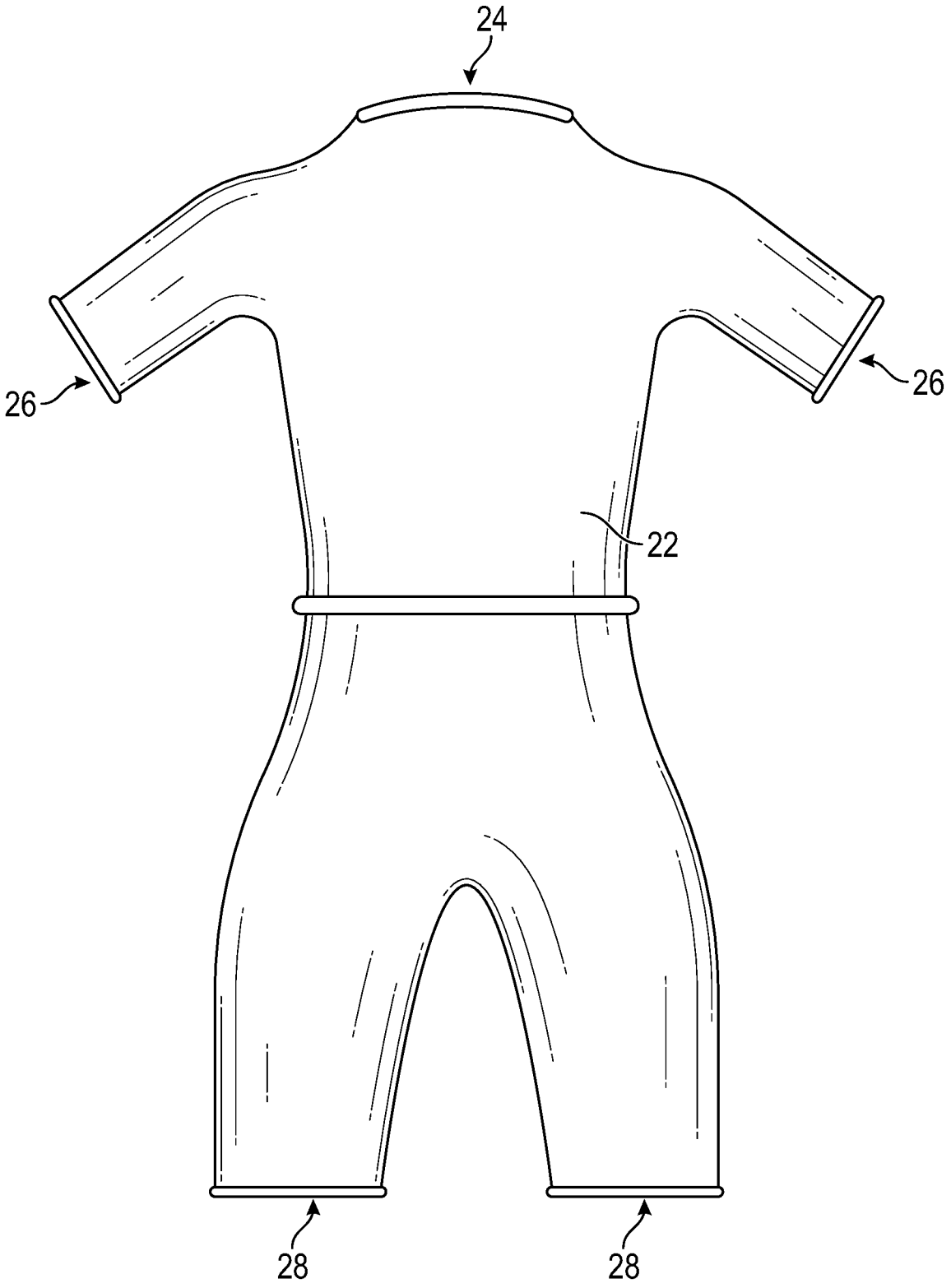
FIG. 3 is a back view of an embodiment of the disclosure.
Figure 4:
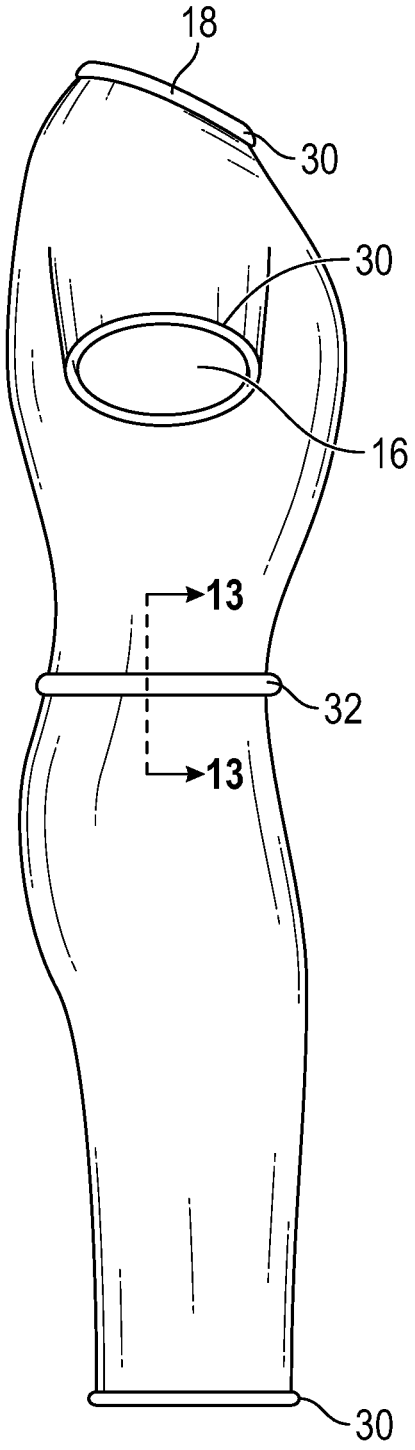
FIG. 4 is a side view of an embodiment of the disclosure.
Figure 5:
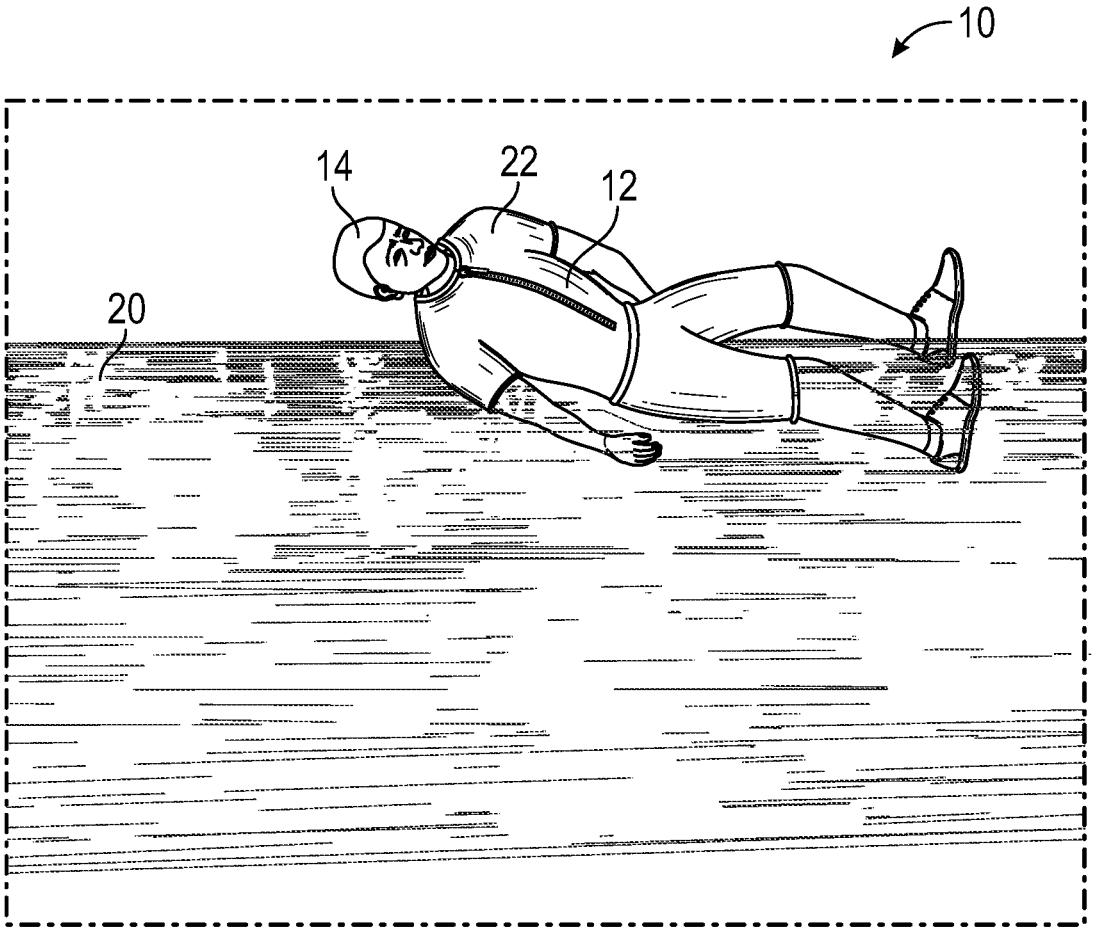
FIG. 5 is an in-use view of an embodiment of the disclosure.

With reference now to the drawings, and in particular to FIGS. 1 through 13 thereof, a new swimwear device embodying the principles and concepts of an embodiment of the disclosure and generally designated by the reference numeral 10 will be described.

As best illustrated in FIGS. 1 through 13, the floatation apparel system 10 generally comprises a garment 12 configured for being worn by a user 14 while engaged in aquatic activities. The garment 12 includes a plurality of body apertures 16 configured to have a portion of a person's body extending therethrough. Each body aperture 16 has a perimeter edge and at least one tubular ring 18 is attached to the garment 12 and is co-extensive with one of the body apertures 16. Furthermore, at least one tubular ring 18 is buoyant in a body of water 20 wherein providing floatation for the user 14.

Figure 13:
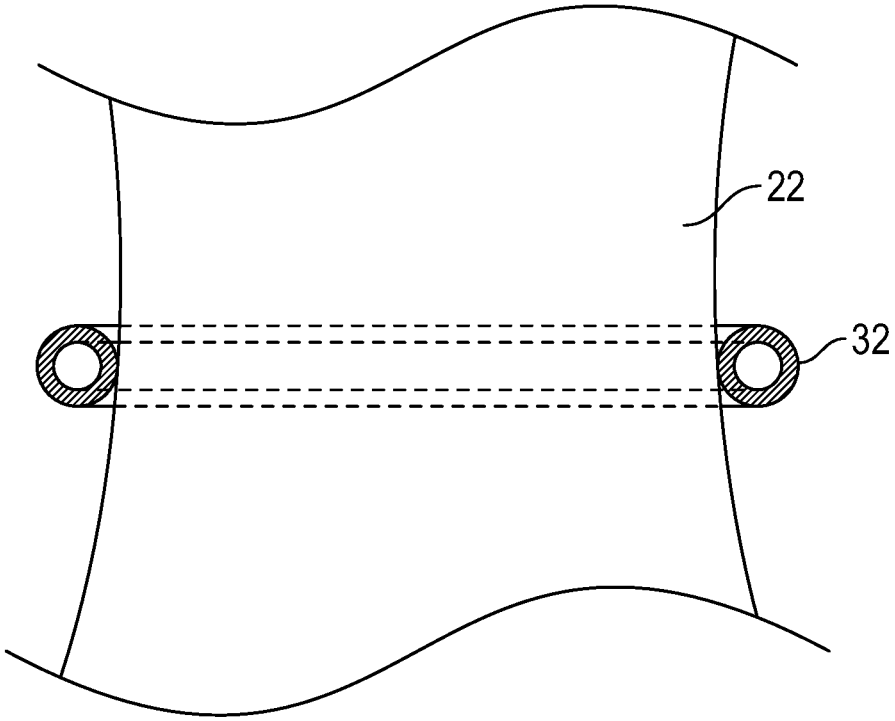
FIG. 13 is a cross-sectional view of an embodiment of the disclosure taken from FIG. 4 of Line 13-13.

The garment 12 is selected from the group comprising a wetsuit, a dry suit, a female two-piece swimsuit, a female one-piece swimsuit, and swimming trunks. At least one tubular ring 18 comprises a flexible material being bendable about the portion of the person's body extending through each body aperture 16. Additionally, at least one tubular ring 18 is a tube inflated with air wherein providing buoyancy to the garment 12, as shown in FIG. 13.

The garment 12 comprising a wetsuit 22, as shown in FIG. 1, defines the plurality of body apertures 16 of the wetsuit 22 including a neck opening 24, a pair of arm openings 26, and a pair of leg openings 28. At least one tubular ring defines 18 a first tubular ring of a plurality of tubular rings 30 being positioned on the neck opening 24. Each of the arm openings 26 and the leg openings 28 has one of the plurality of the tubular rings 30 positioned thereon wherein providing buoyancy to each of the arm 24 and leg 26 openings. The wetsuit 22 may also include a waist ring 32 comprising a buoyant material attached and extending around a waist area of the wetsuit 22.

Figure 6:
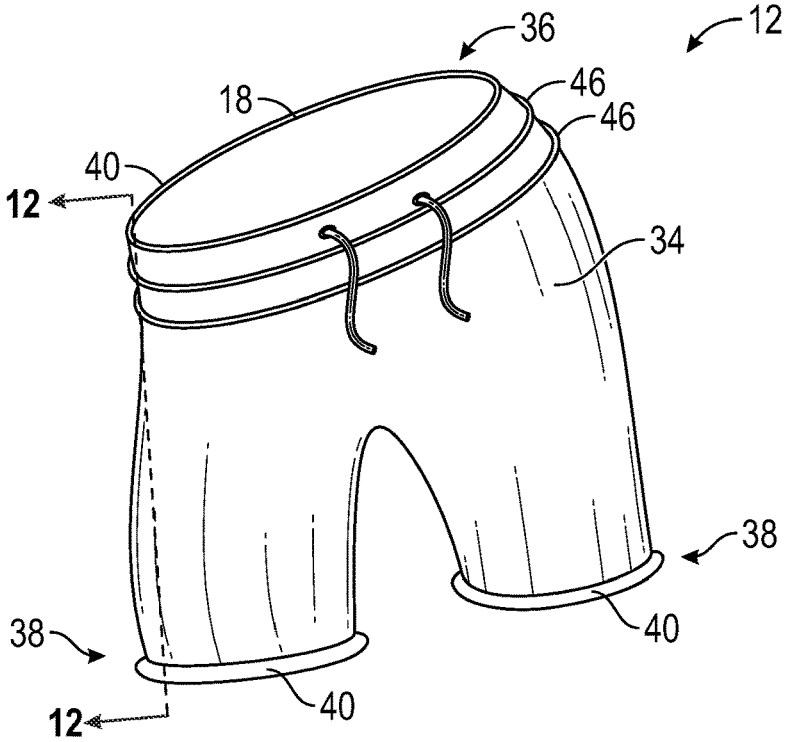
FIG. 6 is a front isometric view of an alternative embodiment of the disclosure.
Figure 12:
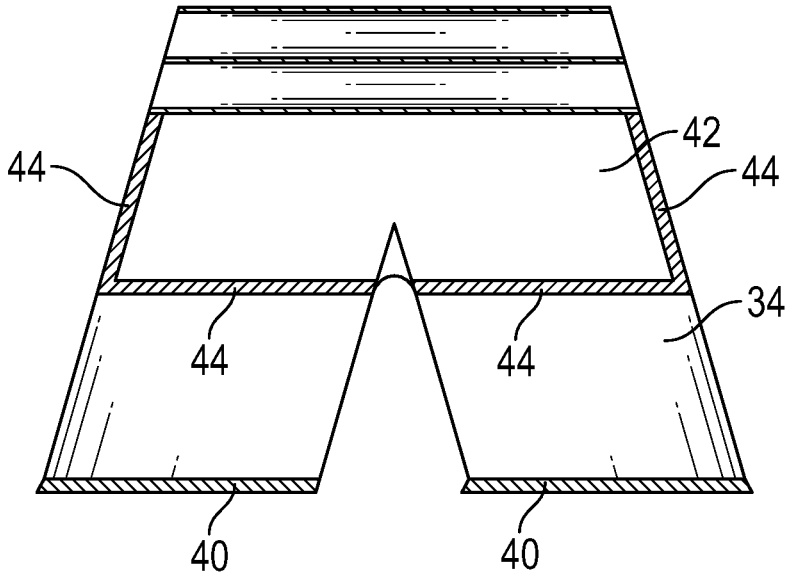
FIG. 12 is a cross-sectional view of an alternative embodiment of the disclosure taken from FIG. 6 of Line 12-12.

The garment 12 comprising swimming trunks 34, as shown in FIG. 6, defines the plurality of body apertures 16 of the swimming trunks 34 including a waist opening 36 and a pair of leg openings 38. At least one tubular ring 18 defines a first tubular ring of a plurality of tubular rings 40 being positioned on the waist opening 36 and each of the leg openings 38 has one of the plurality of the tubular rings 40 positioned thereon providing buoyancy to the waist 36 and leg 38 openings. Furthermore, a liner 42 is positioned within and is attached to the swimming trunks 34 as shown in FIG. 12. The liner 42 will typically be made of a synthetic fabric having some elasticity. A buoyant tube 44 may be attached to a perimeter of the liner 42. At least one auxiliary flotation tube 46 may also be attached to and extend around the swimming trunks 34 adjacent to the first tubular ring 18.

Figure 7:
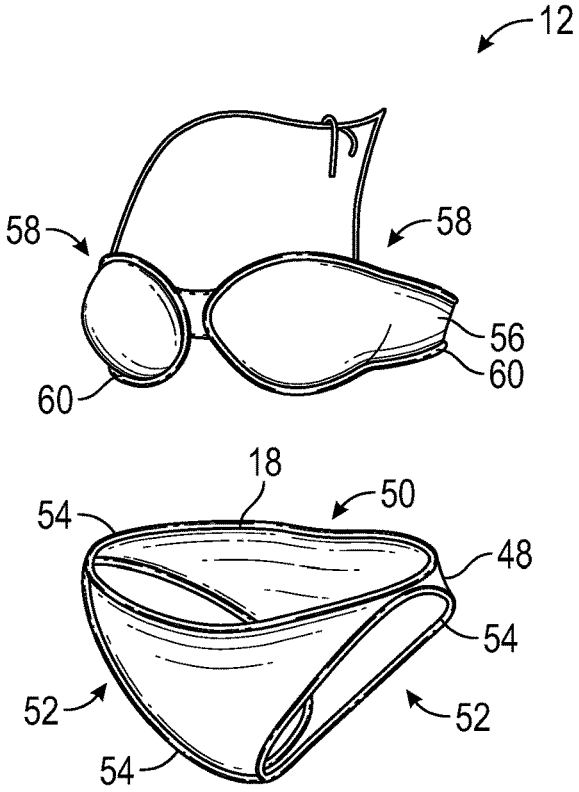
FIG. 7 is a front isometric view of an alternative embodiment of the disclosure.

The garment 12 comprising a bottom piece swimsuit 48, as shown in FIG. 7, defines the plurality of body apertures 16 of the bottom piece swimsuit 48 including a waist opening 50 and a pair of leg openings 52. At least one tubular ring 18 defines a first tubular ring of a plurality of tubular rings 54 being positioned on the waist opening 50 and each of the leg openings 52 has one of the plurality of the tubular rings 54 positioned thereon. Furthermore, a top piece swimsuit 56 comprises a pair of breast cups 58 coupled to each other wherein a buoyant channel 60 is attached to a perimeter of each of the breast cups 58. The bottom piece swimsuit 48 and the top piece swimsuit 56 are complementary to each other and configured for being worn simultaneously by the user 14.

Figure 8:
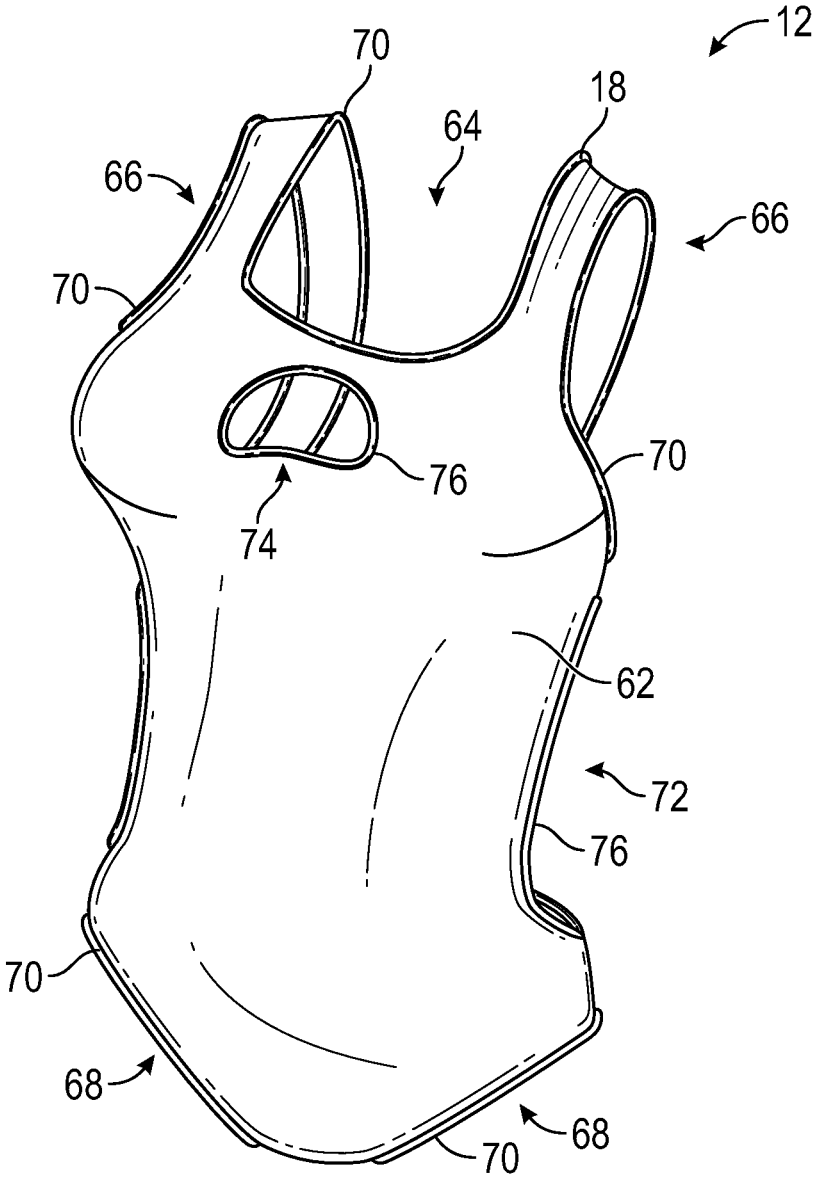
FIG. 8 is a front isometric view of an alternative embodiment of the disclosure.
Figure 9:
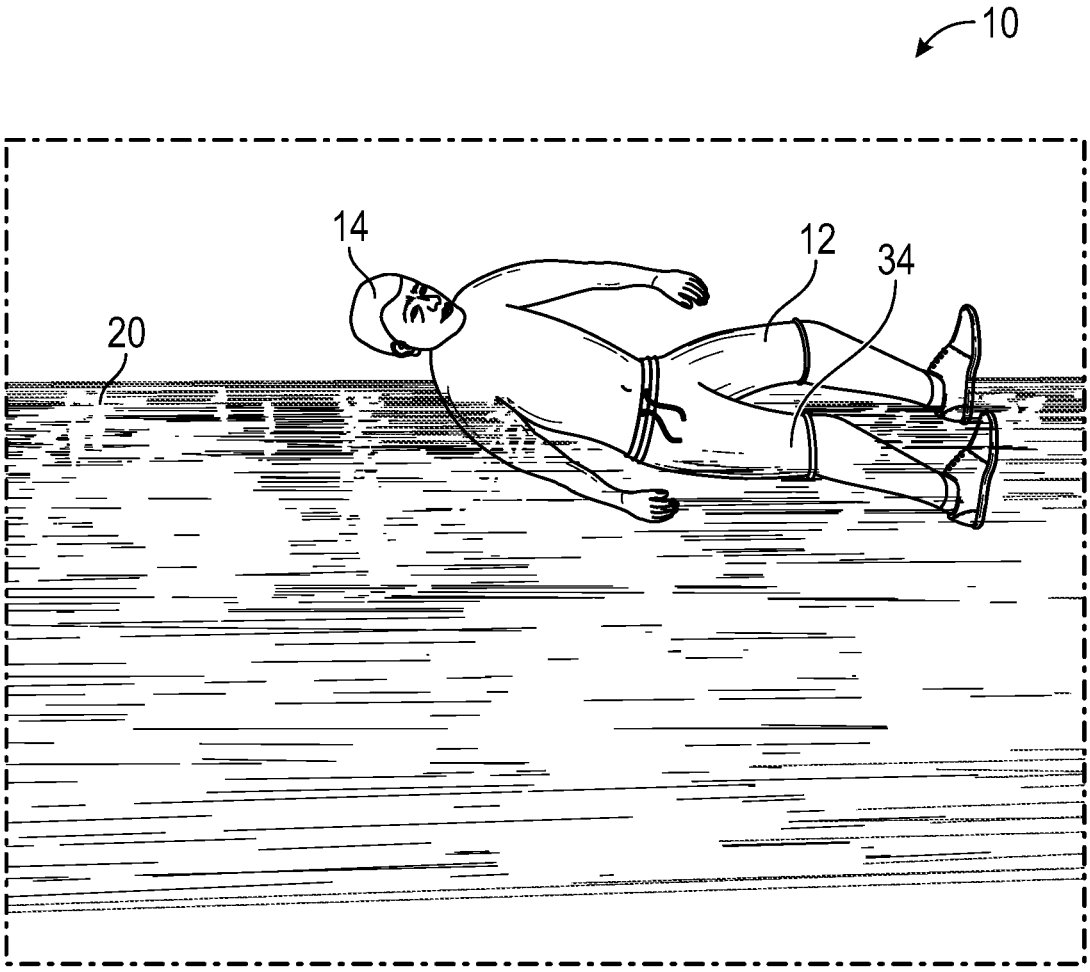
FIG. 9 is an in-use view of an alternative embodiment of the disclosure.
Figure 10:
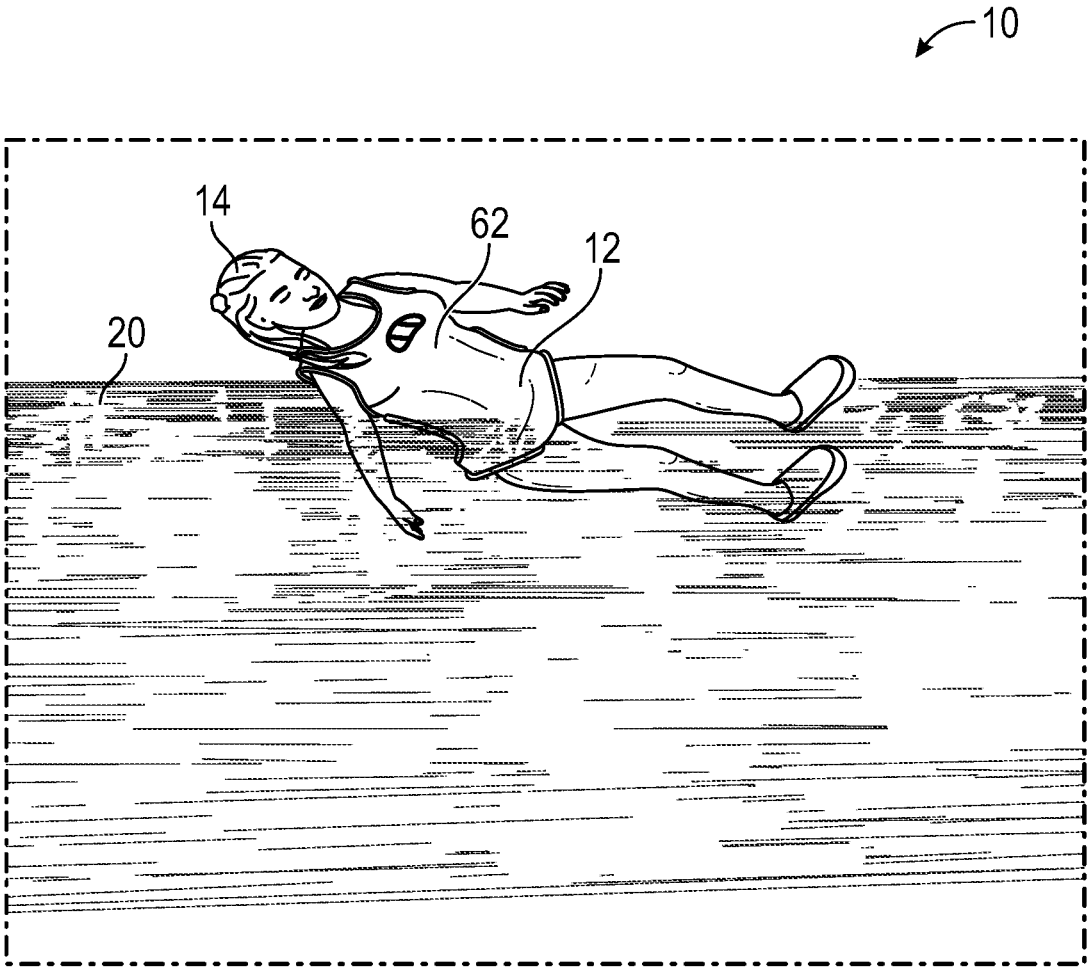
FIG. 10 is an in-use view of an alternative embodiment of the disclosure.
Figure 11:
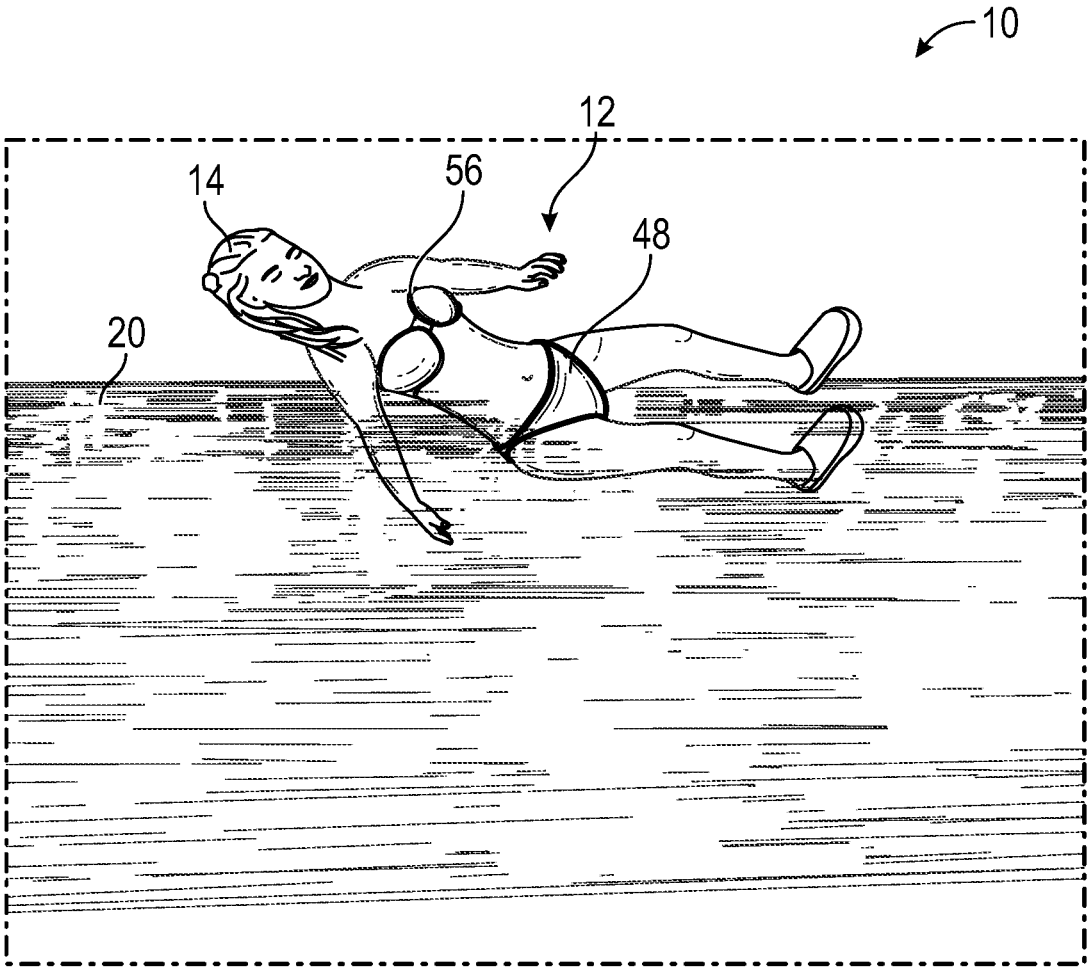
FIG. 11 is an in-use view of an alternative embodiment of the disclosure.

The garment 12 comprising a one-piece swimsuit 62, as shown in FIG. 8, defines the plurality of body apertures 16 of the one-piece swimsuit 62 including a neck opening 64, a pair of arm openings 66, and a pair of leg openings 68. At least one tubular ring 18 defines a first tubular ring of a plurality of tubular rings 70 being positioned on the neck opening 74. Each of the arm openings 66 and the leg openings 68 has one of the plurality of the tubular rings 70 positioned thereon. The garment 12 includes a back opening 72 and a front opening 74 wherein a floatation duct 76 is attached to a perimeter of each of the back 72 and front 74 openings.

In use, the user 14 dresses in the garment 12 prior to engaging in aquatic activities involving a body of water 20. At least one tubular ring 18 provides buoyancy to the garment 12. The buoyancy therefore also provides buoyancy to the wearer of the garment 12 to facilitate the wearer's ability to float in the water 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A floatation apparel system configured for discreetly providing buoyancy to swimwear, the floatation apparel system comprising:

a garment configured for being worn by a user while engaged in aquatic activities;

said garment including a plurality of body apertures configured to have a portion of a person's body extending therethrough, each body aperture having a perimeter edge;

at least one tubular ring being attached to said garment and being co-extensive with one of said body apertures, said at least one tubular ring being buoyant in water;

said garment comprising a one-piece swimsuit wherein said plurality of body apertures of said one-piece swimsuit includes a neck opening, a pair of arm openings, and a pair of leg openings;

said at least one tubular ring defines a first tubular ring of a plurality of tubular rings, said first tubular ring being positioned on said neck opening; and each of said arm openings and said leg openings having one of said plurality of said tubular rings positioned thereon.

2. The floatation apparel system as in claim 1, wherein said at least one tubular ring comprising a flexible material.

3. The floatation apparel system as in claim 2, wherein said at least one tubular ring is a tube inflated with air.

4. The floatation apparel system configured for discreetly providing buoyancy to swimwear as in claim 1, further including:

said garment comprising a wetsuit, wherein said plurality of body apertures of said wetsuit includes a neck opening, a pair of arm openings, and a pair of leg openings;

said at least one tubular ring defines a first tubular ring of a plurality of tubular rings, said first tubular ring being positioned on said neck opening; and each of said arm openings and said leg openings having one of said plurality of said tubular rings positioned thereon.

5. The floatation apparel system configured for discreetly providing buoyancy to swimwear as in claim 4, further including a waist ring comprising a buoyant material being attached to said wetsuit and extending around a waist area of the wetsuit.

6. A floatation apparel system configured for discreetly providing buoyancy to swimwear, the floatation apparel system comprising:

a garment configured for being worn by a user while engaged in aquatic activities;

said garment including a plurality of body apertures configured to have a portion of a person's body extending therethrough, each body aperture having a perimeter edge;

at least one tubular ring being attached to said garment and being co-extensive with one of said body apertures, said at least one tubular ring being buoyant in water;

said garment comprising swimming trunks wherein said plurality of body apertures of said swimming trunks includes a waist opening and a pair of leg openings;

said at least one tubular ring defines a first tubular ring of a plurality of tubular rings, said first tubular ring being positioned on said waist opening; and each of said leg openings having one of said plurality of said tubular rings positioned thereon;

a liner being positioned within and attached to said swimming trunks; and a buoyant tube being attached to a perimeter of said liners.

7. A floatation apparel system configured for discreetly providing buoyancy to swimwear, the floatation apparel system comprising:

a garment configured for being worn by a user while engaged in aquatic activities;

said garment including a plurality of body apertures configured to have a portion of a person's body extending therethrough, each body aperture having a perimeter edge;

at least one tubular ring being attached to said garment and being co-extensive with one of said body apertures, said at least one tubular ring being buoyant in water;

said garment comprising swimming trunks wherein said plurality of body apertures of said swimming trunks includes a waist opening and a pair of leg openings;

said at least one tubular ring defines a first tubular ring of a plurality of tubular rings, said first tubular ring being positioned on said waist opening; and each of said leg openings having one of said plurality of said tubular rings positioned thereon; and at least one auxiliary flotation tube being attached to and extending around said swimming trunks adjacent to said first tubular ring.

8. The floatation apparel system configured for discreetly providing buoyancy to swimwear as in claim 6, further including:

at least one auxiliary flotation tube being attached to and extending around said swimming trunks adjacent to said first tubular ring.

9. A floatation apparel system configured for discreetly providing buoyancy to swimwear, the floatation apparel system comprising:

a garment configured for being worn by a user while engaged in aquatic activities;

said garment including a plurality of body apertures configured to have a portion of a person's body extending therethrough, each body aperture having a perimeter edge;

at least one tubular ring being attached to said garment and being co-extensive with one of said body apertures, said at least one tubular ring being buoyant in water;

said garment comprising a bottom piece swimsuit, wherein said plurality of body apertures of said bottom piece swimsuit includes a waist opening and a pair of leg openings;

said at least one tubular ring defines a first tubular ring of a plurality of tubular rings, said first tubular ring being positioned on said waist opening; and each of said leg openings having one of said plurality of said tubular rings positioned thereon;

a top piece swimsuit comprising a pair of breast, cups coupled to each other; and a buoyant channel being attached to a perimeter of each of said breast cups.

10. The floatation apparel system configured for discreetly providing buoyancy to swimwear as in claim 1, further including:

said garment including a back opening and a front opening;

a floatation duct being attached to a perimeter of each of said back and front openings.

* * * * *